US007098774B2

(12) United States Patent
Davenport et al.

(10) Patent No.: US 7,098,774 B2
(45) Date of Patent: Aug. 29, 2006

(54) METHOD AND APPARATUS FOR MONITORING AND CONTROLLING WARNING SYSTEMS

(75) Inventors: David Davenport, Niskayuna, NY (US); Ralph Hoctor, Saratoga Springs, NY (US); William Hatfield, Schenectady, NY (US); Kuna Kishore, Banagalore (IN); Mukesh Soni, Chhattisgarh (IN); Dennis Cusano, Scotia, NY (US)

(73) Assignee: General Electric Company, Niskayuna, NY (US)

( * ) Notice: Subject to any disclaimer, the term of this patent is extended or adjusted under 35 U.S.C. 154(b) by 247 days.

(21) Appl. No.: 10/248,120

(22) Filed: Dec. 19, 2002

(65) Prior Publication Data

US 2004/0119587 A1 Jun. 24, 2004

(51) Int. Cl.
*G08B 5/00* (2006.01)

(52) U.S. Cl. ..... 340/331; 340/458; 246/473 R

(58) Field of Classification Search ..... 340/310.01, 340/458, 641, 635, 619, 545.3, 331; 246/473 R, 246/473.1, 125
See application file for complete search history.

(56) References Cited

U.S. PATENT DOCUMENTS

| | | | | |
|---|---|---|---|---|
| 4,518,963 | A * | 5/1985 | Rogers, Jr. | 340/981 |
| 4,934,633 | A * | 6/1990 | Ballinger et al. | 246/473.1 |
| 5,022,613 | A * | 6/1991 | Peel | 246/125 |
| 6,218,953 | B1 * | 4/2001 | Petite | 340/641 |
| 6,222,446 | B1 * | 4/2001 | Hilleary | 340/458 |
| 6,271,815 | B1 * | 8/2001 | Yang et al. | 345/82 |
| 6,369,704 | B1 | 4/2002 | Hilleary | 340/458 |
| 6,642,856 | B1 * | 11/2003 | DeMarco et al. | 340/981 |
| 2002/0000911 | A1 * | 1/2002 | Hilleary | 340/458 |

* cited by examiner

*Primary Examiner*—Phung T. Nguyen
(74) *Attorney, Agent, or Firm*—Fletcher Yoder

(57) ABSTRACT

A system for monitoring and controlling activation of a warning system includes a sensor module locally coupled to the warning system for sensing and controlling a flashing light of the warning system, a transceiver responsive to a microcontroller, and a power line interface for interfacing between the transceiver and the power line servicing the warning system. The sensor module includes a sensor arranged for sensing the flashing light, the microcontroller coupled to the sensor, and a power supply for providing power to the sensor module.

37 Claims, 8 Drawing Sheets

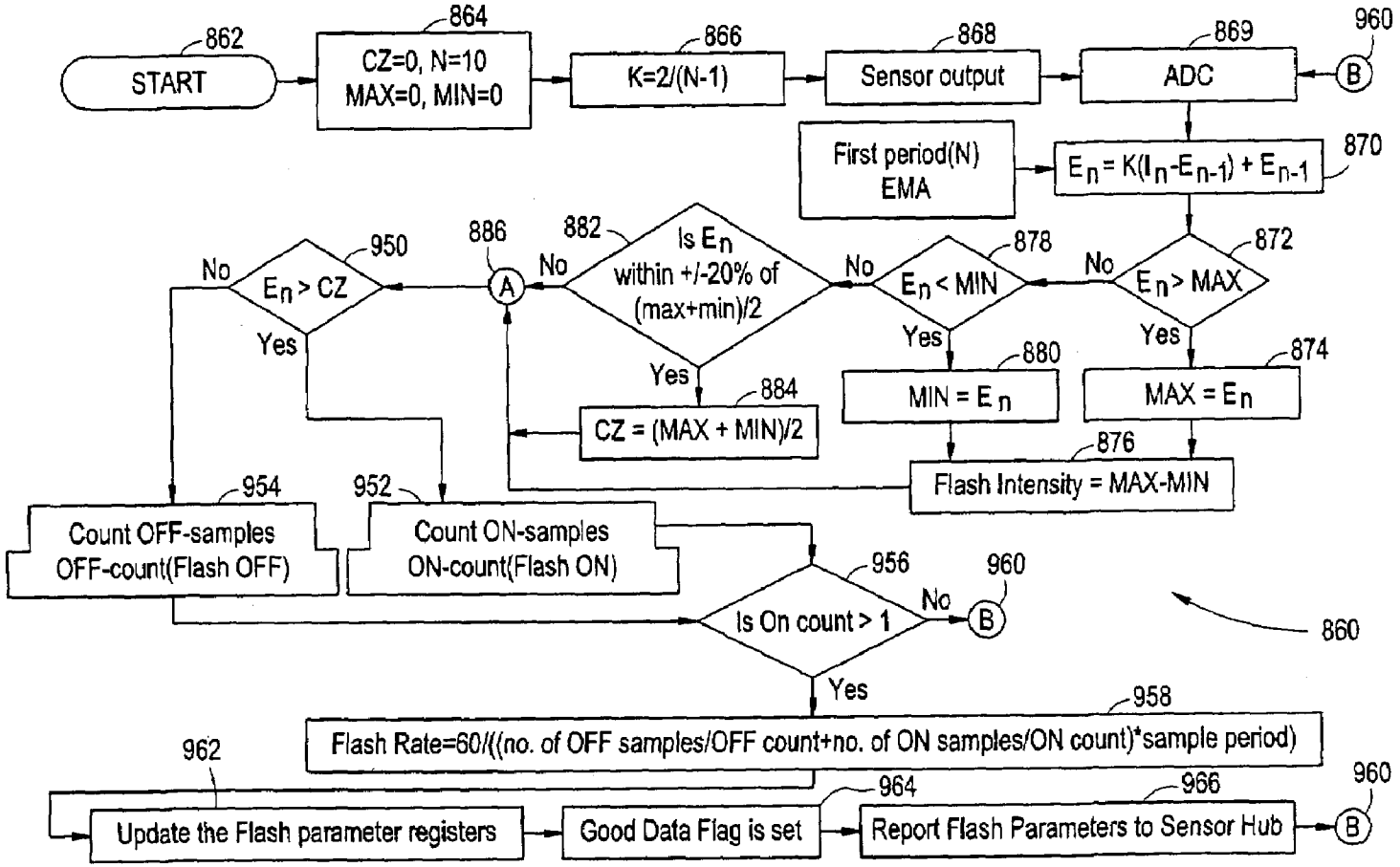
FIG. 7
860
862
START
864
CZ=0, N=10
MAX=0, MIN=0
866
K=2/(N-1)
868
Sensor output
869
ADC
960
B
870
$E_n = K(I_n - E_{n-1}) + E_{n-1}$
First period(N)
EMA
872
$E_n$ > MAX
Yes
No
874
MAX = $E_n$
876
Flash Intensity = MAX-MIN
878
$E_n$ < MIN
Yes
No
880
MIN = $E_n$
882
Is $E_n$ within +/-20% of (max+min)/2
Yes
No
884
CZ = (MAX + MIN)/2
886
A
950
$E_n$ > CZ
Yes
No
952
Count ON-samples
ON-count(Flash ON)
954
Count OFF-samples
OFF-count(Flash OFF)
956
Is On count > 1
Yes
No
958
Flash Rate=60/((no. of OFF samples/OFF count+no. of ON samples/ON count)*sample period)
962
Update the Flash parameter registers
964
Good Data Flag is set
966
Report Flash Parameters to Sensor Hub

METHOD AND APPARATUS FOR MONITORING AND CONTROLLING WARNING SYSTEMS

BACKGROUND OF INVENTION

The present disclosure relates generally to a warning system, and particularly to the monitor and control of the warning system.

Various types of active warning devices are installed at railroad-highway grade crossings to warn motorists of an approaching train. Typical active warning devices include bells, flashing lights (singular or plural), and gates, for example. Locally isolated warning systems require local inspection to ensure proper operation and maintenance, which is time intensive and costly. Specific aspects of a flashing light warning system that must be periodically inspected include light intensity presented to the motorist, flash period of the flashing light, and proper alignment of the flashing light with the roadway approach. An alternative to the locally isolated warning system is a centrally controlled warning system, which includes a central controller that receives, processes, and responds to sensor data. Centrally controlled warning systems are costly to install and do not provide local intelligence at the sight of the warning system.

SUMMARY OF INVENTION

In one embodiment, a system for monitoring and controlling activation of a warning system includes a sensor module locally coupled to the warning system for sensing and controlling a flashing light of the warning system, a transceiver responsive to a microcontroller, and a power line interface for interfacing between the transceiver and the power line servicing the warning system. The sensor module includes a sensor arranged for sensing the flashing light, the microcontroller coupled to the sensor, and a power supply for providing power to the sensor module.

In another embodiment, a method for monitoring and controlling a warning system includes receiving power from a power supply, receiving a sensor input at a microcontroller, processing the sensor input at the microcontroller, communicating the sensor input to an equipment bungalow via a power line interface, and recording the sensor data from the sensor input at a data recorder.

In a further embodiment, a method for estimating the light intensity of a flashing light at a warning system includes processing a sensor signal to identify flash intensity during "ON" and "OFF" portions of a flashing light cycle, comparing light intensity values between the "ON" and "OFF" portions of the flashing light cycle, and determining lamp "ON" intensity above ambient light.

In another embodiment, a system for monitoring and controlling a warning system includes a power supply means for providing power to monitor and control the warning system, a control means for controlling the warning system, a monitoring and recording means for monitoring the warning system and recording information relating thereto, a mounting means for mounting a sensor to the warning system, a communication means for communication sensed information relating to the warning system to maintenance personnel, a detection means for detecting performance degradation of the warning system, a status detection means for detecting the status of the warning system, a warning means for detecting abnormal conditions at the warning system, a detection means for detecting negative influences from environmental effects at the warning system, and a communication means for accessing operating standards stored at a data recorder.

BRIEF DESCRIPTION OF DRAWINGS

Referring to the exemplary drawings wherein like elements are numbered alike in the accompanying Figures:

FIG. 7 is an exemplary process for estimating a control threshold in the system of FIG. 1;

DETAILED DESCRIPTION

An embodiment of the present invention provides an apparatus and method for monitoring and controlling activation of a visual warning system, such as a flashing light warning system, at a railroad crossing that may also include crossing gates. While the embodiment described herein depicts a flashing light system as an exemplary warning system, it will be appreciated that the disclosed invention is also applicable to other warning systems, such as traffic light, fire alarm, noxious fume alarm, or over temperature alarm warning systems for example. The exemplary embodiment monitors the remote crossing warning systems from a central location, using sensors to determine status and performance of warning devices and compliance with predetermined operating points, thereby performing central monitoring of the remote (locally isolated) warning systems rather than central controlling of the remote warning systems.

Figure 1:
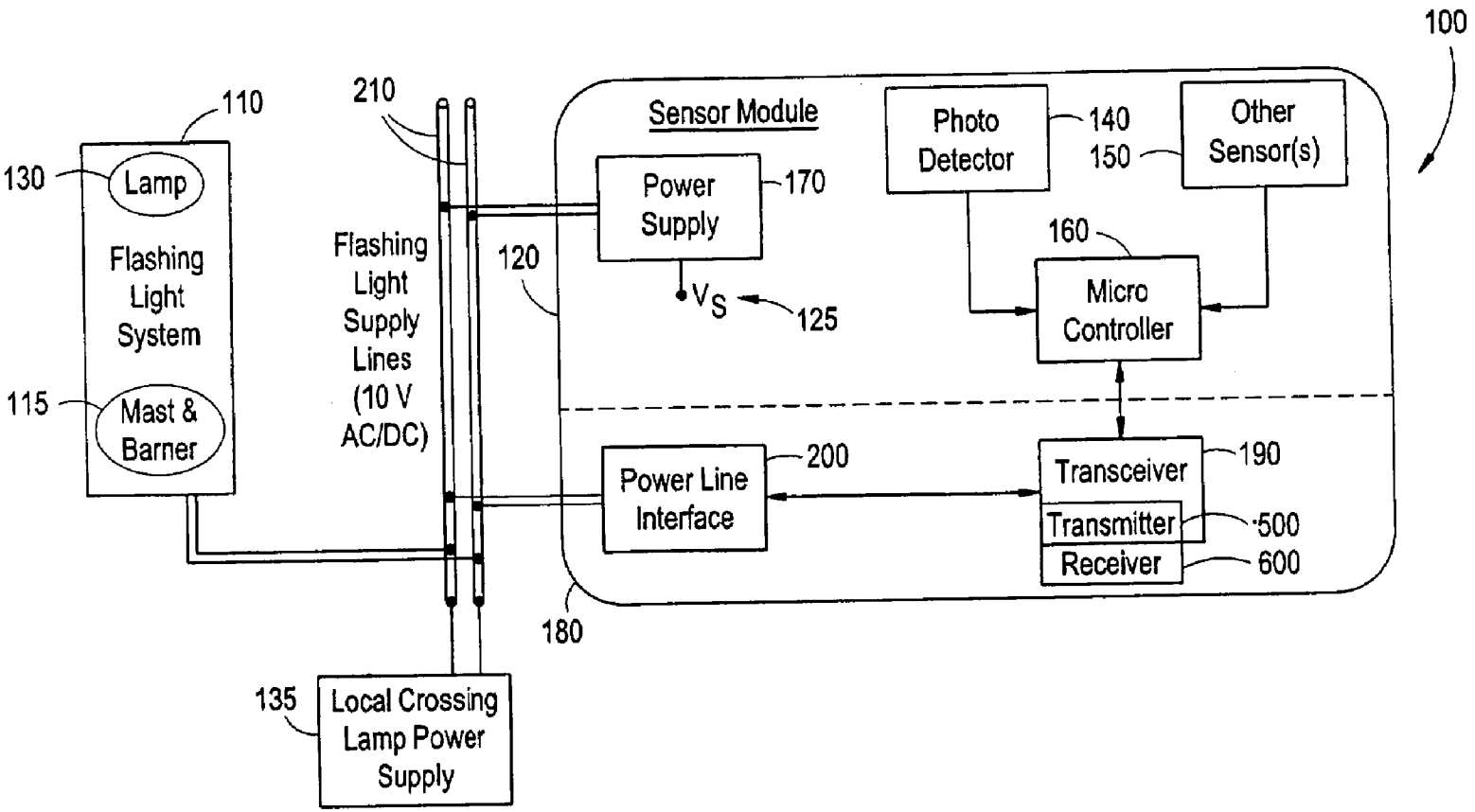
FIG. 1 is an exemplary schematic of a monitoring and controlling system in accordance with an embodiment of the invention.

FIG. 1 is an exemplary embodiment of a system 100 for monitoring and controlling the activation of a warning system 110, such as a railroad crossing flashing light system for example. The system 100 includes a sensor module 120 that is locally coupled to flashing light system 110 for sensing and controlling a flashing light (lamp) 130. Flashing light 130 may consist of a single lamp or a plurality of lamps. By locally coupling sensor module 120 to flashing light system 110, the monitoring, analysis and control of flashing light 130 can all be handled locally, with multiple systems being integrated via power line communication interfaces, to be discussed in more detail below, thereby establishing a distributed control network. A local power supply 135 provides power to the local crossing lamp 130. Sensor module 120 includes a sensor 140 arranged for sensing flashing light 130, other sensors 150 optionally arranged for sensing additional lights, light alignment, temperature, noise, gate position, or gate acceleration for example, a microcontroller 160 coupled to sensors 140, 150 for receiving sensor inputs, and a parasitic power supply 170 for providing power to sensor module 120 through voltage input Vs 125. Parasitic power supply 170 affords continuous operation of sensor module during lamp activation intervals and is discussed in more detail below in reference to FIG. 5. Microcontroller 160 employs known microprocessor techniques, has multiple analog/digital (A/D) converters (not shown) that can support multiple sensors 140, 150, and may employ a controller area network (CAN) protocol or other serial bus protocol for data exchange.

In a typical crossing configuration there is no local power supply, rather there are one or more low voltage power supplies, which are derived from 60 Hertz utility power that is stepped down from 110 Volts to 10 Volts and used to charge one or more batteries. One of the batteries is typically used to power a train detection circuitry and a flashing light controller, and a second battery is typically used for powering the crossing lights, bells, and gate for example. The number of low voltage batteries may vary according to a specific application. When an approaching train is detected, equipment in bungalow 240 triggers the alternate flashing of the lamps 130, which includes the opening and closing of the power circuit to the lamps 130. Thus, half of the lamps 130 flash "ON" when the other half flash "OFF", and vice versa. In an embodiment of the invention, parasitic capacitor power supply 170 allows sensor module 120 to operate continuously throughout the flash "ON" and "OFF" sequence, thereby enabling sensing of both "ON" and "OFF" lamp intensities. In this arrangement, local power supplies are not required in the lamp head 270 to power the lamp 130 and the sensor 140. Also not required are additional timing signals to determine a lamp "ON" condition.

System 100 also includes a transceiver module 180 having a transceiver 190 and a power line interface 200. Transceiver 190 communicates with microcontroller 160 and power line interface 200. Power line interface 200 interfaces between transceiver 190 and the power line 210 servicing flashing light system 110. Power line interface 200 affords a band pass filter response which attenuates the AC or DC flashing light power signal while enabling the chosen power line communication frequency carrier signal to pass without attenuation. A frequency on the order of about 50 kHz or about 100 kHz may be utilized as power line carrier signal. In an alternative embodiment, transceiver module 180 is integrated with sensor module 120.

Figure 2:
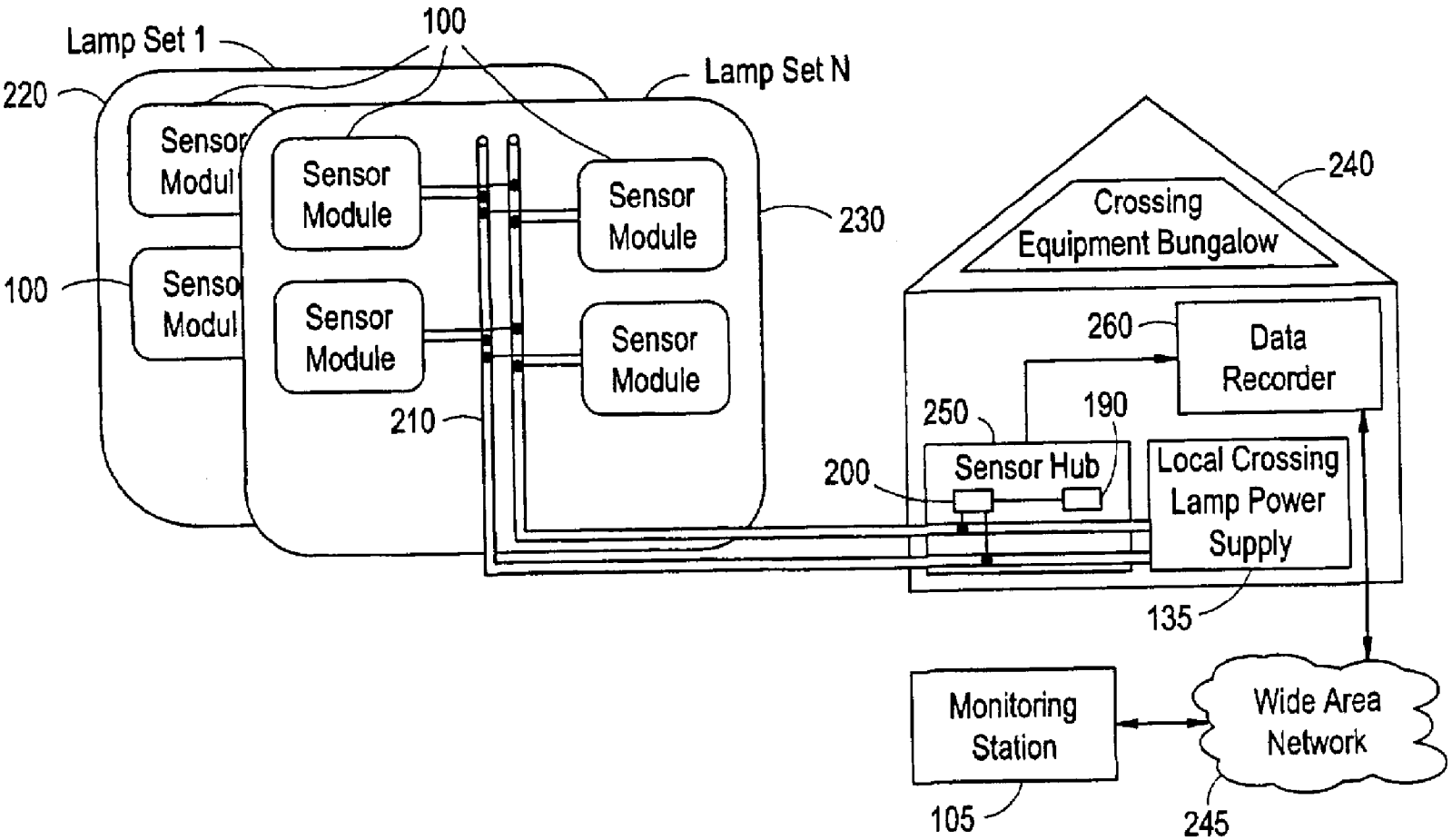
FIG. 2 is an exemplary schematic of a plurality of monitoring and controlling systems of FIG. 1.

Referring now to FIG. 2, a plurality of systems 100 are depicted interfacing with a given power line 210 that services a given lamp set 220. Other lamp sets 230 may be configured in a similar manner, the plurality of lamp sets 220, 230 interfacing with an equipment bungalow 240 through their individual power line interface 200. Equipment bungalow 240 includes a sensor hub 250 for processing information received from power line interface 200 and a data recorder 260 for recording and managing the data received from sensor hub 250. Sensor hub 250 performs demodulation of multiple data streams from multiple sensor modules 120, including the address of the lamp 130 being serviced by the sensor 120, and forwards the data to data recorder 260, which may be a HAWK data recorder from manufacturer General Electric (GE) Transportation Systems Global Signaling for example. Data recorder 260 also hosts functional algorithms and threshold values that may be distributed to multiple sensor modules 120 for subsequent comparative analysis, the algorithms and values being retained at memories (not shown) within microcontrollers 160. By utilizing a common data recorder 260 for a plurality of lamp sets 220, 230, independent operational configurations can be easily communicated to any one of the lamp sets 220, 230. Performance thresholds may be applied at data recorder 260 on conditioned sensor data communicated from sensor nodes, or alternatively the performance thresholds may be distributed to sensor module 120 for local application. In the latter case, sensor module 120 forwards a go/no go indicator to data recorder 260.

Sensor hub 250, which includes one transceiver 190 for each flashing light circuit of flashing light system 110, operates as a combiner for multiple power line circuits and interacts with those multiple power line circuits via power line interface 200. A crossing typically has two masts, each mast having four lights. Half of the lights on a given mast flash "ON" while the other half are "OFF". Thus, there are two flashing light circuits per mast. A crossing may have multiple masts as well as overhead cantilever structures with additional flashing lights. To avoid a short circuit between power supplies during power line communications, each flashing light circuit has a separate transceiver, which demodulates data bits off its respective power line communications circuit and forwards the resulting signal to another microcontroller or to a shared memory. In this manner, sensor hub 250 acts like an active multiplexer.

In another embodiment, sensor module 120 incorporates other sensors 150 for monitoring all four lights on a mast. In such a configuration, only one power line circuit of the two supplying the mast is used for exchanging sensor data with sensor module 120.

Figure 3:
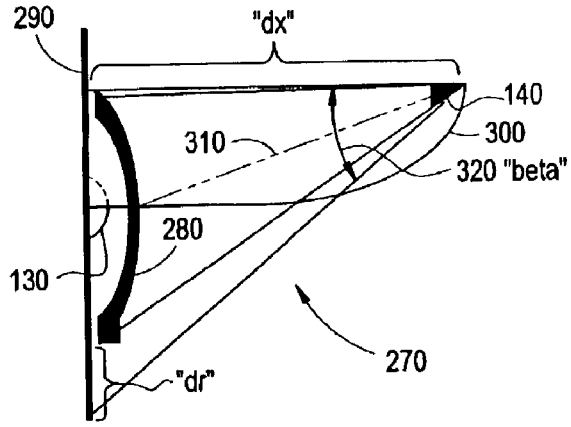
FIG. 3 is an exemplary illustration of a sensor arrangement employed in the system of FIG. 1.

The location of sensor 140 on flashing light system 110 for monitoring lamp 130 is best seen by now referring now to FIG. 3, which depicts a lamp head 270 (a component of flashing light system 110) having a lamp 130, a roundel 280 for protecting lamp 130 and distributing the light from lamp 130 according to a desired pattern, a background plate 290 extending a radial distance "dr" around the perimeter of roundel 280, a lamp hood 300 partially surrounding roundel 280 and extending a linear distance "dx" from background plate 290 for shielding lamp 130 and roundel 280 from the influence of ambient light and environmental conditions such as rain, snow and ice, and sensor 140. Sensor 140 is positioned under lamp hood 300 at or close to the linear distance "dx" from background plate 290 and oriented with a central line of sight 310 directed toward the center of roundel 280. Sensor 140 has a field of view acceptance angle "beta" 320 about central line of sight 310 such that at a distance "dx" the field of view of sensor 140 encompasses only roundel 280. However, with structural and positional tolerances, the field of view of sensor 140 may extend beyond the diameter of roundel 280, in which case background plate 290 will prevent sensor 140 from being influenced by the ambient light. In this manner, sensor 140 has a field of view acceptance angle "beta" 320 that is absent a view of ambient light beyond roundel 280 and background plate 290. In an embodiment, the acceptance angle "beta" 320 is 40.6 degrees +/−20 degrees.

Figure 4:
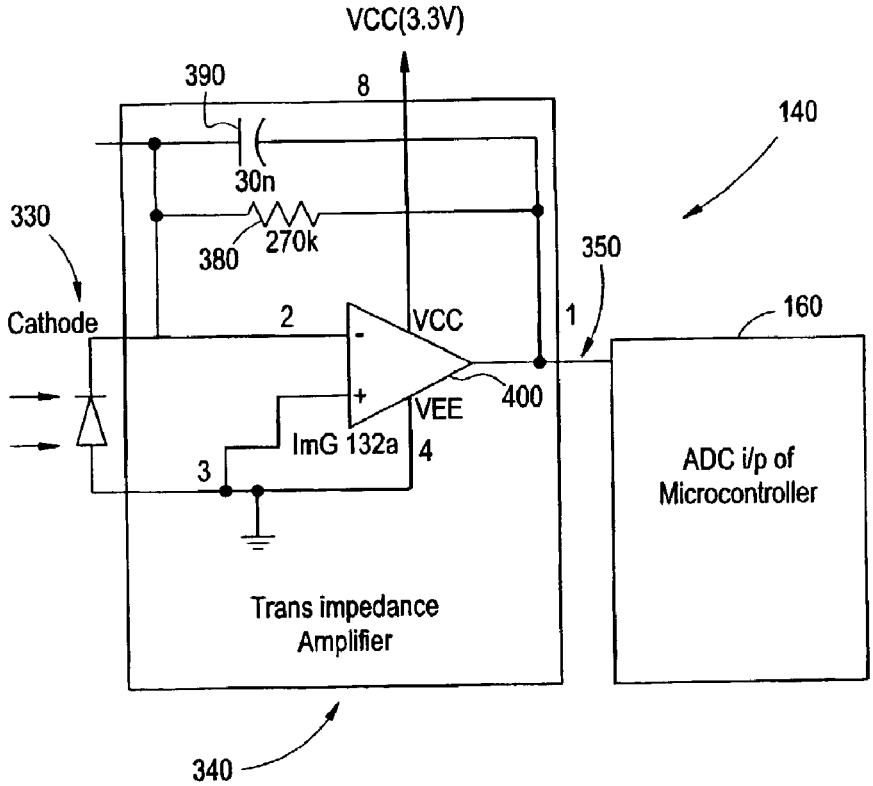
FIG. 4 is an exemplary schematic diagram of a sensor of FIG. 3.

In the exemplary embodiment depicted in FIG. 4, sensor 140 is a photosensor having a photodiode current input 330, a trans-impedance amplifier 340 having a lowpass filter characteristic with a cutoff frequency of about 15 Hertz to about 25 Hertz and preferably 20 Hertz, and an output 350, which is supplied to an analog-to-digital (A/D) converter input of micro controller 160. The output of amplifier 340 is fed to the A/D input pin of micro controller 160. Trans-impedance amplifier 340 includes resistor 380 having a value of about 270 kohms, a capacitor 390 having a value of about 30 nano-farads (nO, and an operational amplifier 400 having a single supply voltage Vcc 410 of about 3.3 volts (V). The value of resistor 380 determines the gain of the trans-impedance amplifier 340 and is selected to correspond the nominal output of the amplified intensity sensor signal with the middle of the available A/D dynamic range. For example, an A/D converter with a maximum input voltage level of 3.0 Volts would suggest that resistor 380 be selected to provide a gain sufficient to amplify the photocurrent to a level of 1.5 Volts.

The exemplary photosensor 140 is responsive to irradiance and provides an indirect measurement of the intensity presented by lamp 130. The photo current generated by the photosensor 140 is linearly dependent upon the incident irradiance over a nominal range of irradiance.

Radiometry is the study of optical radiation. Photometry deals with the visual response of a human to light. As such, radiometry measurements are concerned with total energy content of radiation while photometry focuses on that portion of the radiant energy that humans can see. Radiometric power is expressed as radiant flux, while luminous flux serves to quantify the power of visible light. Irradiance is a measurement of radiometric flux per unit area, or flux density. Illuminance is a measure of visible flux density. Radiant Intensity is a measure of radiometric power per unit solid angle, expressed in watts per steradian. Similarly, luminous intensity is a measure of visible power per solid angle, expressed in candela (lumens per steradian). Intensity is related to irradiance by the inverse square law, shown below in an alternate form: I=E*d2.

Figure 5:
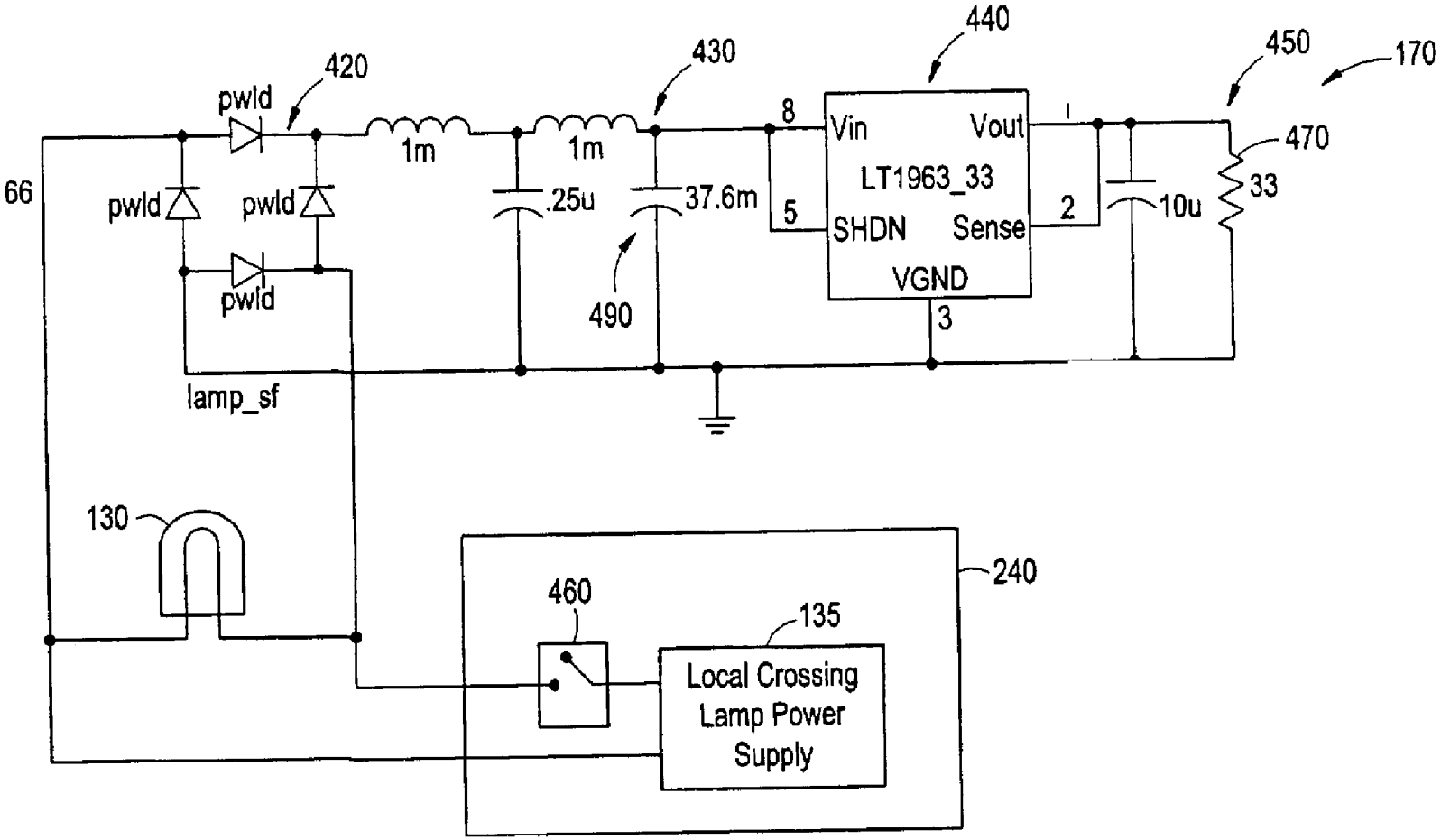
FIG. 5 is an exemplary schematic diagram of a power supply for use in the system of FIG. 1.

As discussed above, system 100 includes parasitic power supply (PPS) 170, which is best seen by now referring to FIG. 5. In general, PPS 170 stores energy from power line 210 servicing flashing light system 110 when flashing light 130 is ON, and provides the stored energy to sensor module 120 when flashing light 130 is OFF. An embodiment of PPS 170 includes a rectifier circuit 420 for rectifying the input power from primary ac power supply 422 or secondary dc power supply 424, an energy storage circuit 430, a regulator 440, a 3.3 Volt output 450 that is connected to voltage input Vs 125 of sensor module 120 (shown in FIG. 1), depicted as a 33 ohm resistor 470 to simulate a dummy load having a 100 milliamp (mA) current draw.

Switch 460 is located along with local crossing lamp power supply 135 in equipment bungalow 240. Upon detection of an approaching train and activation of the crossing warning devices, switch 460 is alternately opened and closed to connect power supply 135 with lamp 130 to light the lamp. Local crossing power supply 135 may be either ac power supply or dc power. When switch 460 is closed, power supply 135 provides power to sensor module 120 and to energy storage circuit 430 when flashing light 130 is ON. When flashing light 130 is OFF, energy storage circuit 430 provides power to sensor module 120 via out 450 and voltage input 125. Energy storage circuit 430 includes a capacitor 490 having a capacitance sized for a specified flash rate. In an embodiment, capacitor 490 has a capacitance of 37.6 micro farads (mF) for a flash rate of 35 flashes-per-minute.

The voltage supplied by power supply 135 and applied across lamp 130 is typically between about 9.5 and about 12 volts ac or dc. The voltage output (at 450, shown with dummy resistor 470 in FIG. 5) from power supply 170 to sensor module 120 is about 3.3 volts at a load current of no greater than about 100 mA. Power supply 170 may take power only from the light it serves, or from both lights in the pair of lights on the alternating flash cycle at the railroad crossing.

Microcontroller 160 is configured with embedded functions for receiving and managing inputs from a plurality of sensors 140, 150. In an embodiment, microcontroller 160 senses light intensity when flashing light 130 is both ON and OFF by receiving a first light intensity signal from sensor 140 when flashing light 130 is ON and a second light intensity signal from sensor 140 when flashing light 130 is OFF, which microcontroller 160 uses to eliminate the ambient light bias intensity from the flashing light intensity. The adjusted flashing light intensity may then be recorded at data recorder 260.

In an embodiment, microcontroller 160 is configured with embedded functions for communicating with transceiver 190, thereby enabling communication with data recorder 260 in equipment bungalow 240. Data recorder 260 not only records data received from microcontroller 160 but also stores predefined nominal operating characteristics (such as flash rate for example), threshold values (such as minimum and maximum lamp intensities), and the logical addresses for multiple lamps 130 being serviced by lamp sets 220, 230. The communication links between sensors 140, 150, microcontroller 160, and data recorder 260, enables microcontroller 160 to analyze the inputs from a plurality of sensors 140, 150 for comparison against the stored nominal operating characteristics and threshold values. In another embodiment, microcontroller 160 is configured with embedded functions for locally testing flashing light system 110 against nominal operating characteristics, the test results being communicated across power line interface 200 to data recorder 260 in equipment bungalow 240. If an abnormal operating condition is detected, microcontroller 160 sends an abnormal condition signal across power lines 210, via power line interface 200, equipment bungalow 240 and wide area network 245, to a monitoring station 105 for corrective action (see FIG. 2). Wide area network 245 may be the internet or any other communication network suitable for the purpose, and may be cable connected or wireless.

Figure 6:
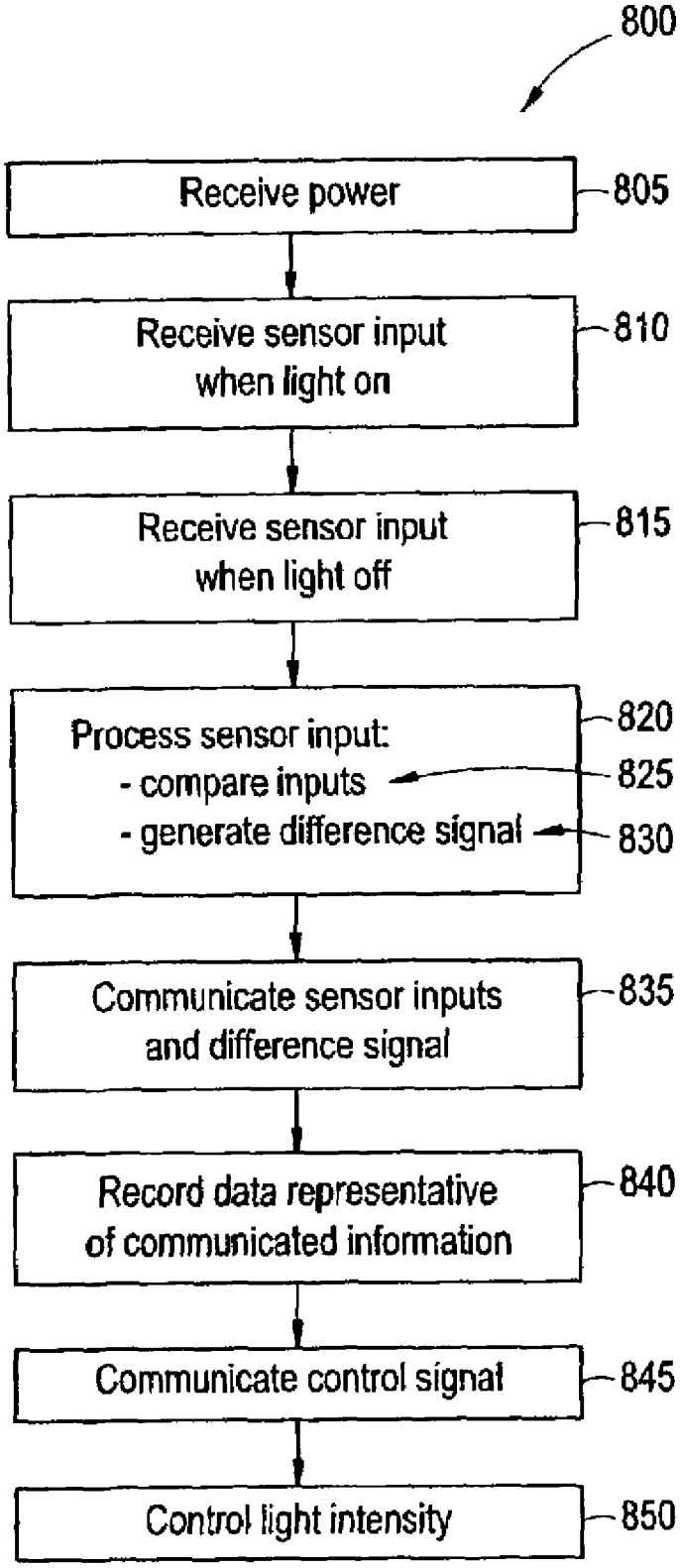
FIG. 6 is an exemplary process employed by the system of FIG. 2.

Referring now to the process 800 of FIG. 6, an embodiment of microcontroller 160 with embedded functions monitors and controls flashing light system 110 by first receiving 805 power from power supply 170, which is received from power supply 135 servicing flashing light 130 when ON and from energy storage circuit 430 when flashing light 130 is OFF. Microcontroller 160 then receives 810, 815 at least one sensor input from sensors 140, 150, which consists of a first (depicted at 810) sensor input when flashing light 130 is ON and a second (depicted at 815) sensor input when flashing light 130 is OFF, the power from energy storage circuit 430 powering microcontroller 160 when flashing light 130 is OFF. Microcontroller 160 then processes 820 the sensor inputs (from blocks 810, 815) by comparing 825 the first sensor input with the second sensor input and generating 830 a differential signal in response thereto, the differential signal representing the intensity of flashing light 130 absent any ambient light influences. Microcontroller 160 then communicates 835 the sensor input and differential signal to equipment bungalow 240 via power line interface 200, where the data is recorded 840 at data recorder 260. When local sensor module 120 receives a command over power line 210 from equipment bungalow 240 to start flashing its lamps, local power supply 135 is on, switch 460 is either non-existent or closed, and sensor module 120 locally controls power to the individual lights 130. Sensor module 120 can adjust the flash rate as well as the voltage level at lights 130, which would indirectly impact the presented intensity of the lamp 130. Sensor module 120 can also measure the voltage available to it to detect any losses due to cable failures and report this anomaly to data recorder 260. In such a manner, sensor module 120 would monitor not only the light, but also the voltage provided by power line conductors 210 and power supply 135. In such an embodiment, sensor module 120 would likely utilize a local switch or relay to flash the light 130 as well as a digitally controlled potentiometer to manage the voltage level presented to lamp 130 to maintain prescribed levels. In essence, the lights 130 are now networked appliances with commands to activate/terminate issued from equipment bungalow's train detection circuitry.

A subroutine (process) 860 for estimating the flash intensity of flashing light 130 is depicted in FIG. 7, which represents one example of an algorithm for estimating flash intensity, and it will be appreciated that other algorithms may be employed without detracting from the scope of the invention.

In general, FIG. 7 depicts an exemplary approach for estimating flash intensity. By processing a sensor signal to identify flash intensity during "ON" and "OFF portions of the flashing cycle, a comparison can be made between absolute maximum intensity values as well as between "ON" and "OFF" intensity values, thereby enabling the determination of the lamp intensity above ambient light. The sensor signal representative of the intensity of the flashing light that is received for processing is passed through a digital low-pass filter (having a cutoff frequency from about 1.5 Hertz to about 2.5 Hertz and preferably 2 Hertz) to remove noise and retain a slow flash waveform, of about 35 to about 65 flashes per minute. This digital low-pass filtering is in addition to the low pass filter characteristic of the photo detector 140 hardware.

Referring now to FIG. 7, exemplary process 860 begins at 862 where the subroutine 860 is entered from a main program (not shown). Upon entering subroutine 860, process flags, such as maximum (MAX) and minimum (MIN) light intensity value flags, period counter (N), and average intensity (CZ) for example, are initialized 864, and process variable (K) is initialized 866. At step 868, a sensor input representative of the intensity of flashing light 130 is received and sent through A/D converter at 869.

At step 870, an exponentially weighted filter is applied to the sensor data sample with low pass frequency characteristic of 2 Hz stated above. A value En is calculated according to the equation:

$$En=k*(In-En-1)+En-1. \qquad \text{Equa. 4}$$

Where subscripts "n" and "n−1" refer to the current and previous data points, respectively. Next, it is determined 872 if the filtered data value En is greater than the maximum value (MAX). If step 872 is true, then MAX is set 874 equal to En and the flash intensity is set 876 equal to the difference between MAX and MIN.

If step 872 is false, then it is determined 878 if En is less than MIN. If step 878 is true, then MIN is set 880 equal to En and the flash intensity is set 876 equal to the difference between MAX and MIN.

If step 878 is false, then it is determined 882 if En is within +/−20% of the sum of MAX plus MIN divided by two. If step 882 is true, then CZ is set 884 equal to (MAX+MIN)/2.

If step 882 is false, then subroutine 860 is returned 886 to the main program with no change in the flash intensity.

After steps 876 and 884, subroutine 860 is transfers 886 to routine "A" with the respective update values.

The CZ crossing point is calculated if average value (EMA) is within 20% of (max+min)/2. This ensures the CZ validity against data fluctuations.

At the entry of routine "A" 886, it is determined 950 whether En is greater than CZ. If 950 is true, then at 952 the ON-samples are counted and the ON-flashes are counted. Since the sampling rate may be different from the flashing rate, both counts are registered. If 950 is false, then at 954 the OFF-samples and OFF-flashes are counted. At 956 it is determined whether an ON condition exists. If 956 is true, then the Flash Rate is calculated according to the equation in block 958. If 956 is false, then program logic passes to path "B" 960 and the program logic enters block 869. After block 958, Flash Parameter Registers are updated at 962, a Good Data Flag is set at 964, and the Flash Parameters are reported at 966 to Sensor Hub 250. In general, routine "A" calculates a valid Flash rate and increments the appropriate logic counter registers.

By employing a controller area network (CAN) link layer protocol within microcontroller 160, which is implemented in hardware in many purchasable microcontrollers (such as PIC18C658 device from Microchip for example), and an ON/OFF signaling scheme (supported by CAN) with a modulated carrier frequency as a physical layer, data can be communicated across power line 210 via transceiver module 180.

Figure 8:
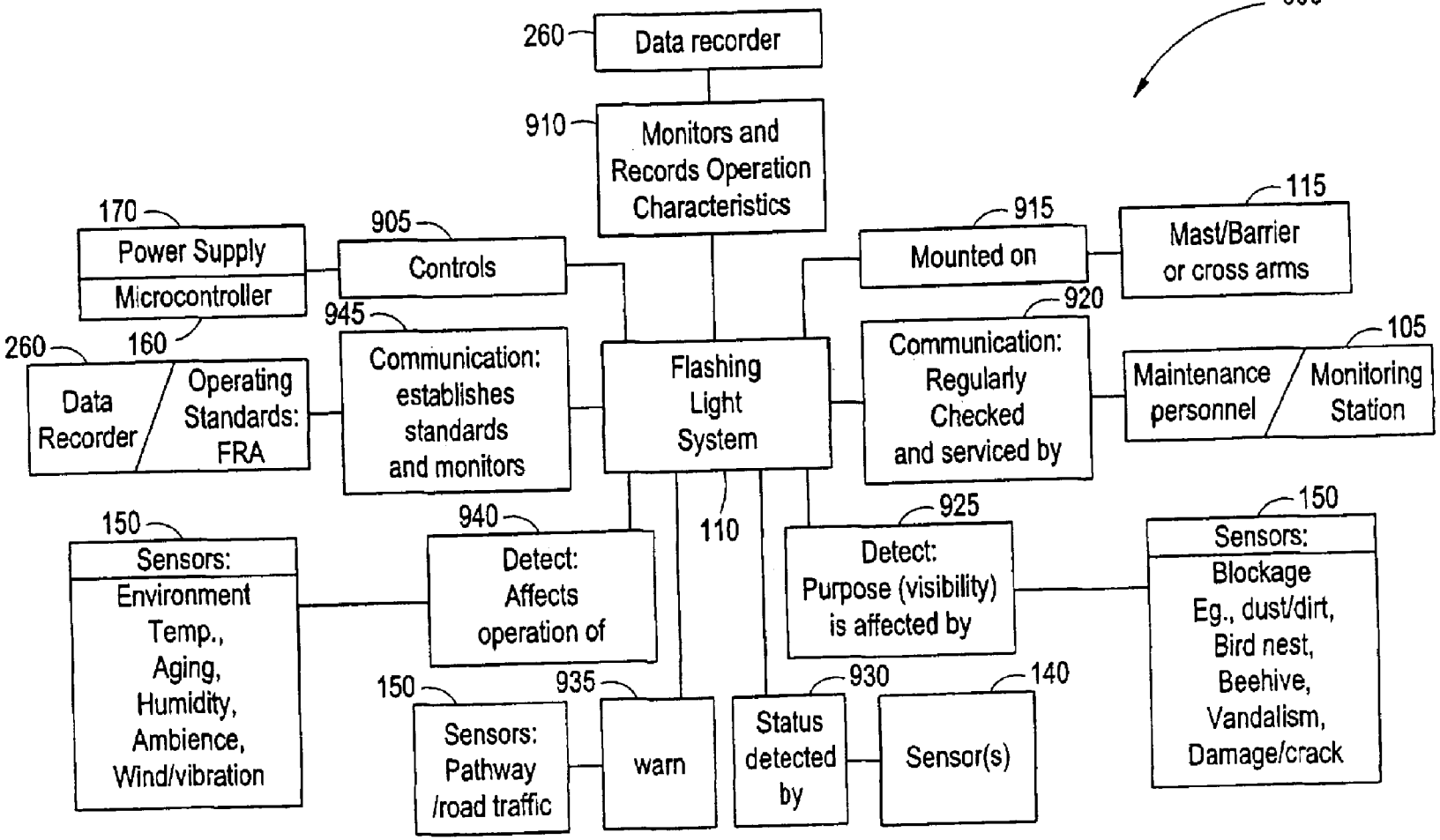
FIG. 8 is an exemplary schematic of a context diagram of a monitoring and controlling system in accordance with an embodiment of the invention.

Referring now to FIG. 8, an alternative embodiment of a system architecture 900 for monitoring and controlling flashing light system 110 is depicted in a context diagram form showing functional elements interconnected by functional links, the functional means for linking one element to another being described herein. Flashing light system 110 is depicted as a central element with multiple peripheral functional elements surrounding it, the peripheral elements connecting to flashing light system 110 through functional links that provide a means for performing the designated function. The functional links include a control means 905 from microcontroller 160 and power supply 170, a monitoring and recording means 910 from data recorder 260, a mounting means 915 from the mast and barrier (cross arms) 115 of flashing light system 110, a communication means 920 from a monitoring station 105 accessible by maintenance personnel, a detection means 925 for detecting performance degradation picked up by sensors 150, a status detection means 930 for detecting the status of flashing light 130 from sensor 140, a warning means 935 for detecting abnormal road conditions picked up by sensors 150, a detection means 940 for detecting negative influences from environmental effects picked up by sensors 150, and a communication means 945 for accessing operating standards stored at data recorder 260.

Control means 905 is provided by microcontroller 160, which interacts between sensors 140, 150 and transceiver 190 to control the information flow through power line interface 200 to power line 210 and equipment bungalow 240. Power to microcontroller 160 is provided by power line 210 and power supply 170, as discussed above. Monitoring and recording means 910 is provided by data recorder 260 in equipment bungalow 240, which is accessible through microcontroller 160. The means of mounting 915 sensors 140, 150 on flashing light system 110 is provided by known methods such as screws, bolts, brackets, welding, for example. An embodiment of sensor 140 mounted on flashing light system 110 is depicted in FIG. 3, where sensor 140 is located at the end of lamp hood 300 by bolts (not shown). A means of communication 920 between flashing light system 110 and maintenance personnel at monitoring station 105 is provided by microcontroller 160. When microcontroller 160 detects and abnormal condition, it sends an abnormal condition signal across power lines 210, via power line interface 200, to a monitoring station 10S for corrective action. Microcontroller 160 may also send scheduled status update information from data recorder 260 to monitoring station 10S for regular maintenance service. Sensors 150 configured to detect changes in line of sight images provide a detection means 925 for detecting performance degradation of flashing light system 110, such degradation may result from dust or dirt buildup, blockage from bird nest or beehives, or damage from vandalism, accidents or other incidents for example. Sensors 140 configured as discussed above for sensing light intensity provide a means 930 for detecting the status of flashing light 130. Sensors 150 configured to detect abnormal road conditions such as the presence of a vehicle on the railroad tracks at the time of crossing signaling, for example, provide a warning means 935 that may be communicated in real time by microcontroller 160 to monitoring station 105 for evasive action. Sensors 150 configured to detect negative environmental influences provide a detection means for signaling such conditions to microcontroller 160 for local action, or to monitoring station 105 for maintenance action. Such sensors 150 may include temperature sensors, humidity sensors, vibration sensors, or timing (time-in-service) sensors, for example. Data recorder 260 provides a means of communicating 945 operating standards (such as FRA (Federal Railroad Administration) for example) to microcontroller 160 for comparison and analysis with detected operations conditions. Operating standards may be stored in data recorder 260 at the time of installation, with updates being uploaded by distributed network communication between monitoring station 105, power line 210, power line interface 200, and equipment bungalow 240.

Figure 9:
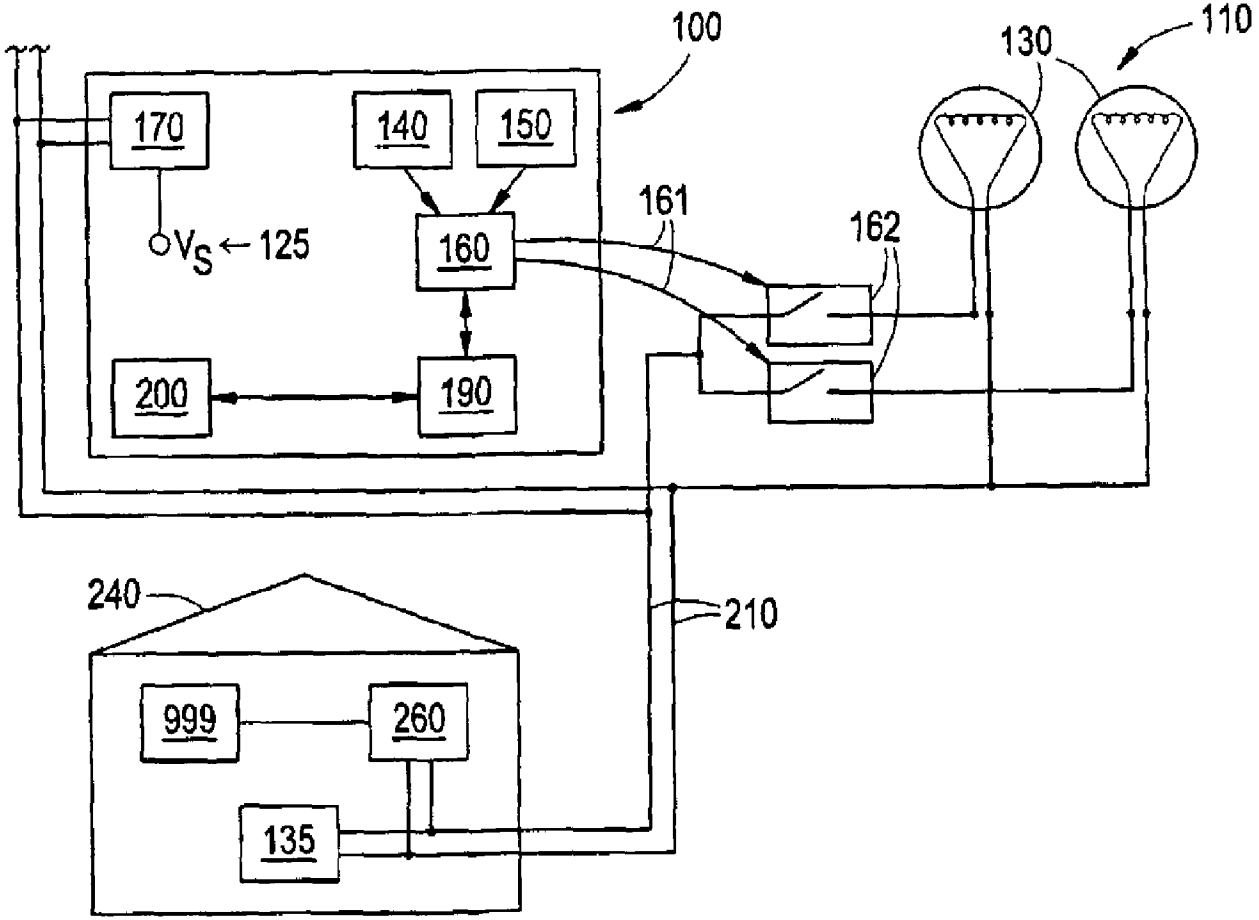
FIG. 9 is an alternative embodiment of the invention.

In a further embodiment depicted in FIG. 9, microcontroller 160 includes embedded functions for locally controlling the ON/OFF state and flash rate of flashing light 130 at any flashing light system 110 connected to the power line network through switches 162, which are accessible and operable by microcontroller 160 via communication lines 161. The embodiment of FIG. 9 is referred to as a networked appliance flashing light system.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

The invention claimed is:

1. A system for monitoring and controlling activation of a warning system, comprising:

a sensor module locally coupled to the warning system and configured to sense and control a flashing light of the warning system, said sensor module comprising a sensor arranged for sensing the flashing light during ON and OFF periods of operation, a microcontroller coupled to said sensor, and a power supply for providing power to said sensor module;

a transceiver responsive to said microcontroller; and a power line interface configured to interface between said transceiver and the power line servicing the warning system.

2. The system of claim 1, further comprising:

an equipment bungalow in signal communication with said power line interface, said equipment bungalow comprising a sensor hub configured to process information from said power line interface and a data recorder configured to manage data received from said sensor hub.

3. The system of claim 1, wherein said sensor comprises:

a field of view acceptance angle beta that is absent a view of ambient light beyond the roundel and background plate of the warning system.

4. The system of claim 3, wherein said sensor further comprises:

a photosensor having a photodiode current input, a transimpedance amplifier having a lowpass filter with a cutoff frequency from about 15 Hertz to about 25 Hertz, and an output for communication with said microcontroller.

5. The system of claim 1, wherein said sensor is responsive to irradiance.

6. The system of claim 1, wherein said microcontroller comprises embedded functions programmed to receive and manage input from a plurality of sensors, said plurality of sensors including at least one of a light sensor, a light alignment sensor, a temperature sensor, a noise sensor, a position sensor, and an acceleration sensor.

7. The system of claim 6, wherein said power supply comprises:

a parasitic energy storage component configured to store energy from the power line servicing the warning system in response to the flashing light being ON, and to provide the stored energy to said sensor module in response to the flashing light being OFF.

8. The system of claim 7, wherein said parasitic energy storage component comprises an energy storage capacitor having a capacitance sized for a given flash rate of the flashing light.

9. The system of claim 8, wherein said energy storage capacitor has a capacitance of about 37.6 microfarads for a flash rate of about 35 flashes per minute.

10. The system of claim 7, wherein said sensor senses light intensity in response to the flashing light being ON and OFF.

11. The system of claim 10, wherein said microcontroller receives a first light intensity signal from said sensor when the flashing light is ON and a second light intensity signal from said sensor when the flashing light is OFF, said microcontroller including embedded functions programmed to eliminate the ambient light bias intensity from the flashing light intensity for subsequent data recording.

12. The system of claim 10, wherein said microcontroller includes embedded functions programmed to analyze the input from said plurality of sensors for comparison with nominal operating characteristics.

13. The system of claim 10, wherein said microcontroller includes embedded functions programmed to locally test the warning system against nominal operating characteristics and to communicate the test results across said power line interface.

14. The system of claim 1, further comprising a switch in operable communication between said microcontroller and the flashing light of the warning system, wherein said microcontroller includes embedded functions programmed to locally control the ON and OFF states of the flashing light at at least one of the local warning system or a networked warning system via communication lines.

15. The system of claim 14, wherein said microcontroller further includes embedded functions programmed to locally control the flash rate of the flashing light at at least one of the local warning system or a networked warning system via said transceiver.

16. The system of claim 1, wherein said microcontroller communicates data over a power line utilizing controller area network link layer protocol standard.

17. A method for monitoring and controlling a warning system, comprising:

receiving power from a power supply;

receiving a sensor input at a microcontroller, the sensor input including a first sensor input when a flashing light is ON and a second sensor input when the flashing light is OFF;

processing the sensor input at the microcontroller;

communicating the sensor input to an equipment bungalow via a power line interface; and recording the sensor data from the sensor input at a data recorder.

18. The method of claim 17, wherein said receiving power from a power supply comprises:

receiving power from a flashing light power supply when the flashing light is ON and from an energy storage power supply when the flashing light is OFF.

19. The method of claim 17, where said processing the sensor input at the microcontroller further comprises:

comparing the first sensor input with the second sensor input and generating a differential signal in response thereto.

20. The method of claim 19, further comprising:

communicating a control signal to the warning system via the power line interface in response to the differential signal and controlling the light intensity of the flashing light in response thereto.

21. A method for estimating the light intensity of a flashing light at a warning system, comprising:

processing a sensor signal to identify flash intensity during "ON" and "OFF" portions of a flashing light cycle;

comparing light intensity values between the "ON" and "OFF" portions of the flashing light cycle; and determining lamp "ON" intensity above ambient light.

22. The method of claim 21, further comprising:

receiving a sensor signal representative of the intensity of a flashing light;

filtering the sensor signal through a low-pass filter to remove noise and retain a predefined flash waveform.

23. The method of claim 22, wherein said filtering further comprises:

filtering the sensor signal through a low-pass filter having a cutoff frequency of about 20 Hertz to remove noise and retain a predefined flash waveform having a flash rate of about 35 flashes per minute to about 65 flashes per minute.

24. A system for monitoring and controlling a warning system, comprising:

a power supply means for providing power to monitor and control the warning system;

a control means for controlling the warning system;

a monitoring and recording means for monitoring the warning system and recording information relating thereto;

a mounting means for mounting a sensor locally to the warning system; wherein the sensor is configured to sense a flashing light of the warning system during ON and OFF periods of operation;

a communication means for communication sensed information relating to the warning system to maintenance personnel;

a detection means for detecting performance degradation of the warning system;

a status detection means for detecting the status of the warning system;

a warning means for detecting abnormal conditions at the warning system;

a detection means for detecting negative influences from environmental effects at the warning system; and a communication means for accessing operating standards stored at a data recorder.

25. A system for monitoring and controlling activation of a light system serviced by a power line, comprising:

a sensor module locally coupled to the light system and configured to sense and control a light of the light system, said sensor module comprising a sensor arranged for sensing the light during ON and OFF periods of operation and a microcontroller coupled to said sensor;

a transceiver responsive to said microcontroller; and a power line interface configured to interface between said transceiver and the power line servicing the light system;

wherein said microcontroller is adapted to activate said light from an OFF state to an ON state and from an ON state to an OFF state.

26. The system of claim 25, wherein said ON state comprises a light having steady illumination.

27. The system of claim 25, wherein said ON and OFF states comprise a light having a flashing illumination.

28. The system of claim 25, wherein said microcontroller comprises embedded functions programmed to receive and manage a signal from a second sensor arranged to detect an approaching train.

29. The system of claim 28, wherein said microcontroller is adapted to activate said light from an OFF state to an ON state, from an ON state to an OFF state, or any combination thereof, in response to the signal from said second sensor.

30. The system of claim 25, wherein said microcontroller is responsive to a train detection signal received from an equipment bungalow via a power line and a power line interface, said microcontroller adapted to locally control the ON and OFF activation of said light in response to said train detection signal.

31. A method for monitoring and controlling activation of a light in a light system, comprising:

receiving at a microcontroller and via a power line interface a command to activate a light state of the light;

controlling the ON and OFF states of the light in response to said activation command;

sensing the state of the light during ON and OFF periods of operation via a light sensor and providing a signal representative thereof;

receiving and processing at the microcontroller the signal representative of the state of the light; and communicating the content of said signal to an equipment bungalow via a power line interface.

32. The method of claim 31, wherein said controlling further comprises:

controlling the intensity of the light in the ON state by receiving at the microcontroller a first light intensity signal from the light sensor in response to the light being ON, receiving at the microcontroller a second light intensity signal from the light sensor in response to the light being OFF, compensating at the microcontroller for ambient light bias intensity and adjusting the intensity of the light in response thereto.

33. The method of claim 31, wherein said controlling further comprises:

changing the state of the light from OFF to ON, from ON to OFF, or any combination thereof.

34. The method of claim 33, wherein said changing further comprises:

changing the state of the light from OFF to ON thereby providing steady illumination.

35. The method of claim 33, wherein said changing further comprises: changing the state of the light from OFF to ON and from ON to OFF thereby providing flashing illumination.

36. The method of claim 35, wherein said controlling further comprises:

controlling the ON and OFF flash rate.

37. The method of claim 31, further comprising controlling the ON and OFF states of the light at least partially in response to an approaching train.

* * * * *